US005682800A

United States Patent [19]

Jore

[11] Patent Number: 5,682,800

[45] Date of Patent: Nov. 4, 1997

[54] CLUTCH DRIVER

[76] Inventor: Matthew B. Jore, P.O. Box 159, Ronan, Mont. 59864

[21] Appl. No.: 611,250

[22] Filed: Mar. 5, 1996

[51] Int. Cl.[6] ..... B25B 23/00

[52] U.S. Cl. ..... 81/429; 81/451

[58] Field of Search ..... 81/429, 451, 438, 81/439, 467, 473, 474, 475, 476

[56] References Cited

U.S. PATENT DOCUMENTS

| | | | |
|---|---|---|---|
| 3,056,441 | 10/1962 | Hlems | 81/429 |
| 3,146,811 | 9/1964 | Shryock | 81/429 |
| 4,030,383 | 6/1977 | Wagner | 81/429 |
| 4,753,142 | 6/1988 | Hornung | 81/429 |
| 5,012,708 | 5/1991 | Martindell | 81/429 |

FOREIGN PATENT DOCUMENTS

| | | | |
|---|---|---|---|
| 3344600 | 6/1985 | Germany | 81/429 |

*Primary Examiner*—D. S. Meislin
*Assistant Examiner*—Joni Danganan
*Attorney, Agent, or Firm*—Richard C. Conover

[57] ABSTRACT

A clutch driver device for releasing torque between a power drill and a screwdriver when the screw being driven reaches a predetermined depth. The clutch mechanism including a hollow release cylinder slideably fitted on a drive shaft integrally formed in coaxial relation with a chuck shank to be inserted into the chuck of a power drill. The release cylinder is movable from a first position where the release cylinder holds several clutch balls against planar faces of a hexagonal end of a drive shank used to drive the screw into the work piece to a second position where the release cylinder releases the clutch balls held against the planar faces of the drive shank so that the screw driving end of the driver is disengaged from the power drill. The release cylinder being moved from the first position to the second position by an actuator sleeve positioned between the work piece and the release cylinder.

1 Claim, 5 Drawing Sheets

CLUTCH DRIVER

BACKGROUND OF THE INVENTION

This invention relates to an improved tool for driving screws which tool is held by a chuck of a conventional power drill. The tool provides a clutch mechanism in cooperation with a screw depth sensor to disengage rotational power from the screwdriver when a predetermined depth is reached.

Tools that have screw driving and depth limiting functions are already known in the art. For instance see U.S. Pat. Nos. 2,940,488; 3,527,273; or 4,647,260. These patents all provide a clutch mechanism for limiting the depth that a screw can be screwed into a workpiece. They each have a problem, however, because they all require the tool to be attached to a power drill with one portion of the tool held in a non-rotating manner and mated to the housing of the power drill, while an interior portion of the tool, a screwdriver bit, is held in the rotating chuck of the power drill. A workpiece engaging portion, illustrated in each of these patents, also force the screw driver bit to be gradually withdrawn from the screw-head upon reaching a predetermined depth. The requirement to have a non-rotating portion of the tool mate in a non-rotating way to a power drill housing, severely restrict these tool's versatility as far as being interchangeable with many differently-shaped, power drills. The gradual withdrawal of the bit, as a screw is driven to its final depth, can mar the top of the screw.

Another patent, U.S. Pat. No. 4,753,142, illustrates a device which permits the tool to be inserted into the chuck of a power drill, but this patent illustrates the use of a fixed length sleeve to release the clutch at predetermined driving depths. If a different driving depth is desired, this patent calls for using interchangeable sleeves of different lengths to compensate for variation in driving depths.

From the above, it can be seen that what is needed is a screw driver attachment that can be easily inserted into the chuck of any power drill. This would permit easy transportability between different power drills. In addition, there should be some easily adjusted depth setting mechanism so that screws can be sunk to different depths in a workpiece without having to change tools. Since in general the type of work, and specifically countersunk hole depth, may vary between jobs, some method of providing an adjustable pre-determined depth would make the tool much more useful.

SUMMARY OF INVENTION

The present invention relates to a clutch driver for a power drill which can be inserted into the chuck of various power drills. Structure is provided to easily adjust the depth a screw is driven. A clutch releases torque between the power drill and the screwdriver when the screw reaches a predetermined depth.

The clutch driver has two portions: a rotating portion which has a chuck shank to be inserted into the chuck of a power drill, and a driving portion for driving a screw. The driving portion having a drive shank received by the rotating portion. Structure is provided to prevent axial displacement between the rotating portion and the driving portion while allowing axial rotation of the rotating portion relative to the driving portion.

A hollow release cylinder is slideably fitted on a drive shaft integrally formed in coaxial relation with the chuck shank. A spring biases the release cylinder in a direction away from the chuck shank that is received by the drill chuck. A stop is provided to prevent the release cylinder from moving away from the drive shaft. In this biased extended position, the release cylinder holds several clutch balls against planar faces of a hexagonal end of the drive shank in order to prevent any rotation between the driving portion and the rotating portion. As the release cylinder is moved against the bias to a retracted position, the release cylinder has an interior groove that moves over the clutch balls to releases the clutch balls held against the planar faces of the hexagonal end of the drive shank. With this structure the driving portion can be moved to a position where the rotating portion is disengaged from the driving portion. When the rotating portion is disengaged, the rotating portion continues to rotate but does not drive the driving portion.

The hexagonal end of the drive shank is inserted into a cylindrical opening provided at the end of the drive shaft opposite the chuck shank. A spindle is integrally formed in coaxial relation with the drive shank. The spindle is provided with an opening at the end opposite the drive shank for receiving a conventional screwdriver bit. A sleeve is slideably fitted on the spindle. As the screwdriver bit engages a screw prior to driving the screw into a workpiece, the sleeve can be extended beyond the screwdriver bit to touch the workpiece and hold the screw in place. As the screw is driven into place, the sleeve is pushed back toward the drive shaft end of the tool. The sleeve soon engages the release cylinder as it is pushed back. Then, as the screw nears its predetermined depth and the release cylinder is pushed back further toward the drive shaft, the release cylinder finally reaches a point where the clutch balls are released into the interior groove of the release cylinder. Once this happens, the driving portion disengages from the rotating portion, thus stopping the driving of the screw, while the rotating portion continues to rotate by the continued rotation of the power drill chuck.

The end of the release cylinder distal from the chuck shank is provided with external threads. A threaded depth-adjusting collar is threadably mounted on the threaded release cylinder to threadably increase the gap between the release cylinder and the sleeve. This permits an adjustment of the driving depth of the screw.

In a second embodiment, the threaded depth-adjusting collar, is made much longer than in the first embodiment. This longer depth adjusting collar is used to push against a workpiece and the release cylinder to release the clutch balls when a predetermined depth is reached. As the longer depth-adjusting collar pushes the release cylinder back toward the drive shaft, the release cylinder again releases the clutch balls so that the driving portion is no longer forced to rotate with the rotating portion. When this happens the screw is no longer being driven into the workpiece.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
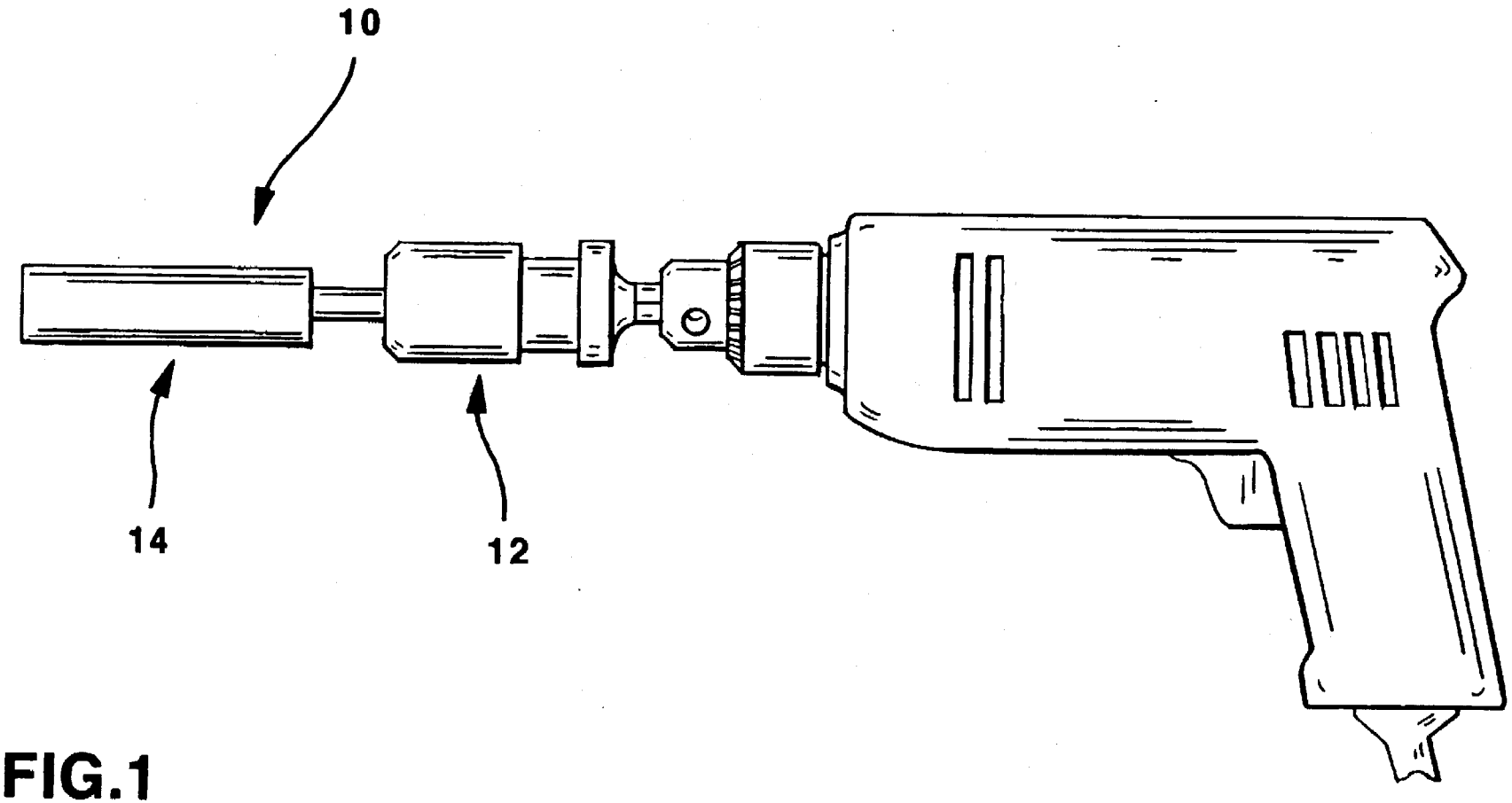
FIG. 1 is an elevational view of a clutch driver according to the present invention clamped in a chuck of a conventional power drill.
Figure 2:
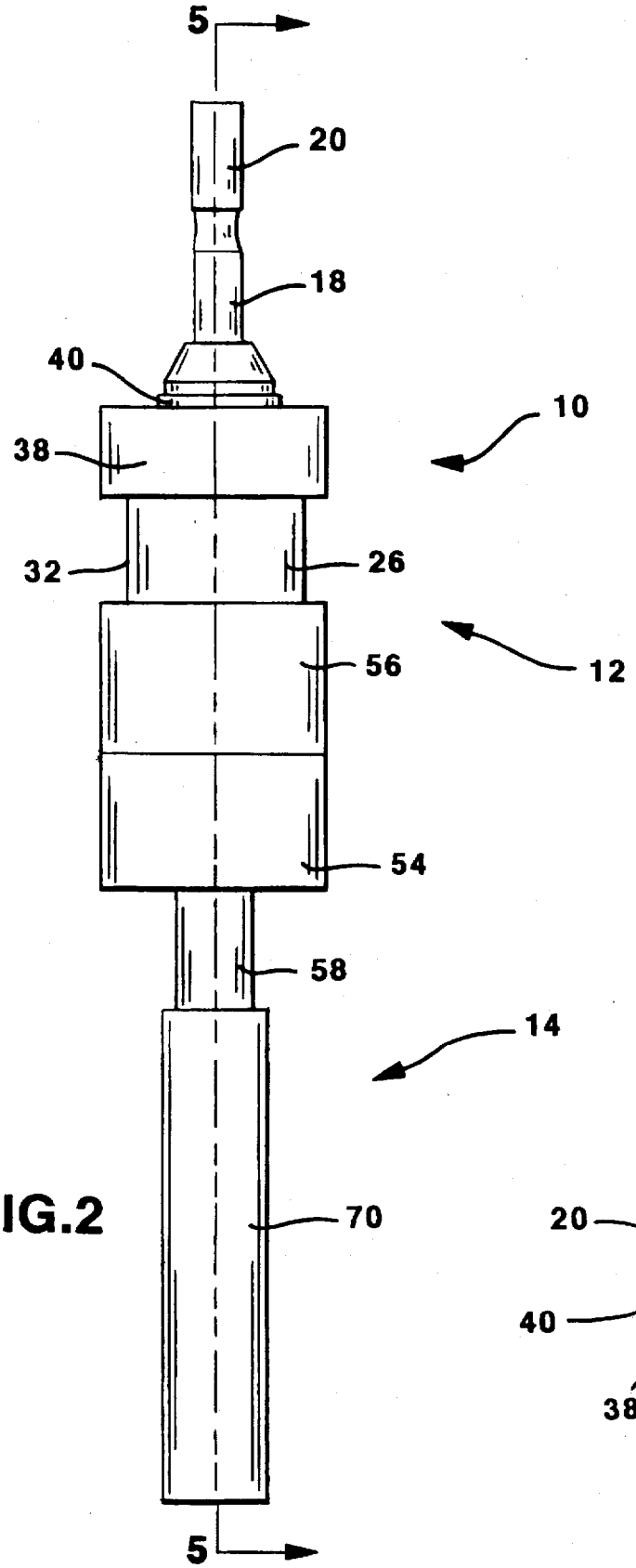
FIG. 2 is an elevational view of a clutch driver according to the present invention.
Figure 3:
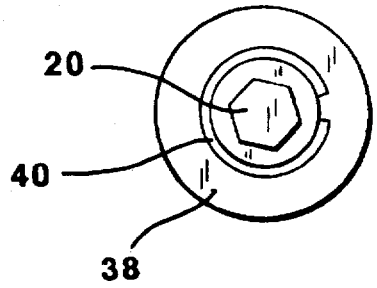
FIG. 3 is a plan view of the clutch driver shown in FIG. 2.
Figure 4:
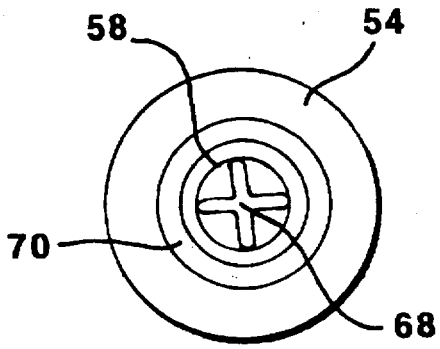
FIG. 4 is a bottom view of the clutch driver shown in FIG. 2.

A preferred embodiment of a clutch driver 10 is shown in FIGS. 1 and 2. Clutch driver 10 has two portions: a rotating portion 12 which is the portion clamped into the chuck of a power drill, and a driving portion 14 which is the portion used to drive a screw.

Rotating portion 12 has a drive shaft 18, which at one end has a chuck shank 20 of polygonal cross-section for being received in a non-slipping manner in a chuck of a power drill.

Figure 6:
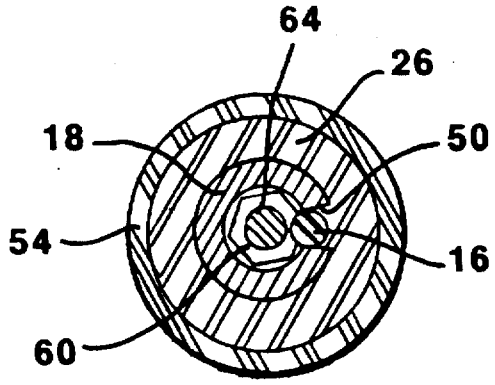
FIG. 6 is a cross-sectional view taken along the line 6—6 in FIG. 5.
Figure 7:
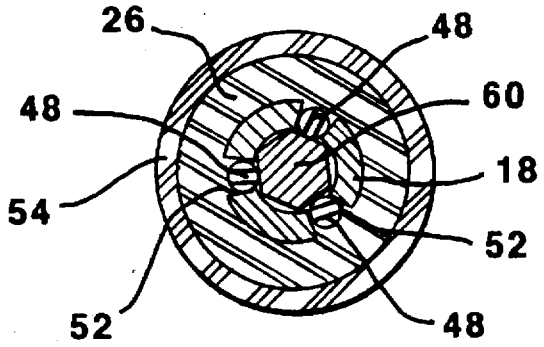
FIG. 7 is a cross-sectional view taken along the line 7—7 in FIG. 5.
Figure 8:
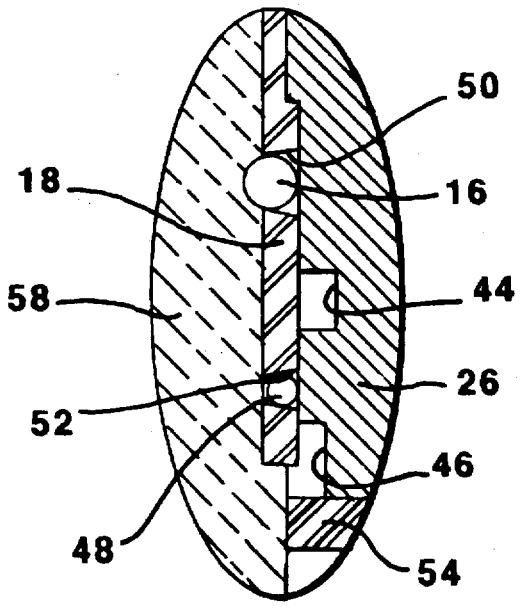
FIG. 8 is an enlargement of a portion of FIG. 2 identified as area 8 in FIG. 5.

At the end of drive shaft 18, opposite the chuck shank, a blind bore 22 open at one end is provided to receive a drive shank end 60 of driving portion 14. A flange 24 is provided on an exterior surface of drive shaft 18. Flange 24 is formed as a step change in outside diameters of drive shaft 18 with the smaller exterior diameter 27 being located closest to the chuck shank and the larger exterior diameter bring located furthest from chuck shank 20. As best seen in FIGS. 6, 7, and 8, drive shaft 18 also has a release ball hole 50, and three clutch ball holes 52 each drilled radially into the drive shaft. The release ball hole 50 and the clutch ball holes 52 are each tapered inwardly to hold their associated balls in the holes if drive shank 60 is ever removed.

Figure 5:
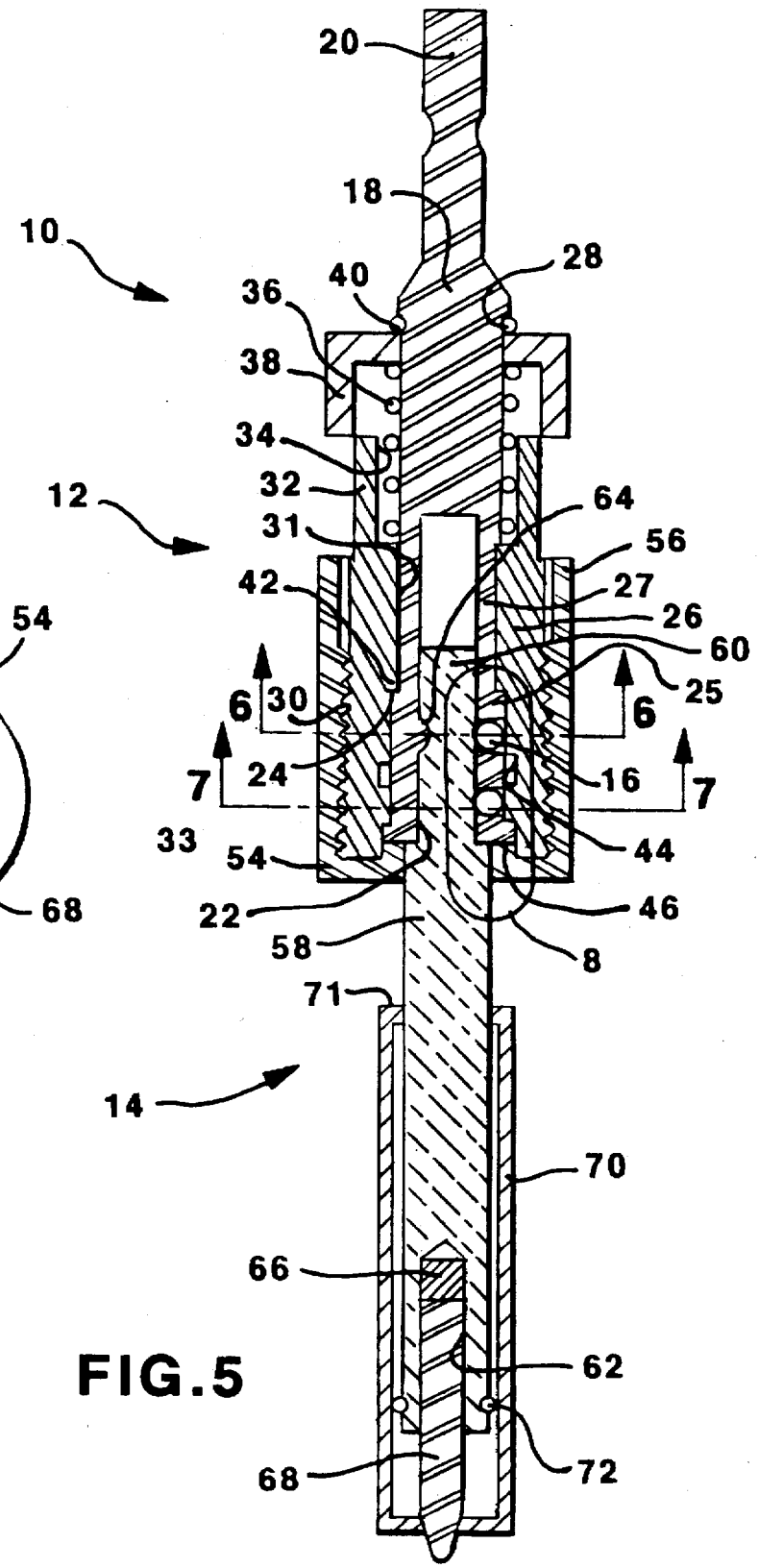
FIG. 5 is a cross-sectional view taken along the centerline shown as 5—5 in FIG. 2.

As shown in FIG. 5, a hollow, release cylinder 26, is slideably fitted around drive shaft 18, and has exterior threads 30 adjacent one end and a smooth exterior surface 32 adjacent the other end. The interior of cylinder 26 has a flange 42 which is a step change of inside diameters with the smaller inside diameter 31 being located at the adjacent end of cylinder 26 closest to the chuck shank 20 and the inside diameter 37 being adjacent the other end of cylinder 26. Inside diameter 31 is sized to mate with corresponding exterior diameter 27 on drive shaft 18; and inside diameter 33 is sized to mate with corresponding exterior diameter 25 on the drive shaft. Flange 42 is positioned in mating relation with flange 24 of drive shaft 18. Because of the change in mating diameters at flange 24 on drive shaft 18 and flange 42 on release cylinder 26, the drive shaft can only be inserted into the release cylinder in one direction. When drive shaft 18 is inserted into release cylinder 26, flange 24 of drive shaft 18 eventually engages flange 42 of release cylinder 26 thus effectively stopping further movement of release cylinder 26 away from chuck shank 20.

As best seen in FIG. 5, the end of release cylinder 26 closest to the chuck shank 20, has an interior surface which is cut into a cylindrical mouth 34 with a diameter larger than the adjacent, smaller inside diameter 31 of the release cylinder. The cylindrical mouth 34 is used to receive a coil spring 36. A cup shaped cap 38 is locked onto drive shaft 18 and over spring 36 by placing a C-spring 40 into a locking groove 28 located on drive shaft 18 on a side of the cap opposite the spring 36. The inside diameter of cap 38 is made large enough to accept smooth surface 32 whenever release collar 26 is slid toward chuck shank 20. By having spring 36 compressed between cap 38 and release cylinder 26, the spring biases the release cylinder away from chuck shank 20 and against the stop created by flange 24 on drive shaft 18 resting against flange 42 on release cylinder 26.

Release cylinder 26 also has a cylindrical groove 44 cut in its interior for releasing lock ball 16. As best seen in FIG. 5, 6, and 8, rotating portion 12 and driving portion 14 are locked by lock ball 16 to prevent axial displacement of the two portions while permitting the rotating portion to rotate relative to the driving portion. Lock ball 16 is positioned in release ball hole 50 so that it can move radially outwardly whenever lock ball release groove 44 is located over release ball hole 50. When groove 44 is not aligned with release ball hole 50, lock ball 16 extends radially inwardly to prevent axial displacement of the rotating and driving portions.

As shown in FIGS. 5, 7, and 8 release cylinder 26 further includes another cylindrical groove 46 for receiving clutch balls 48 whenever clutch ball release groove 46 is located over the clutch balls 48. When groove 46 and clutch balls 48 are not so aligned, the interior surface of release cylinder 26 positions clutch balls 48 to extend radially inwardly from their respective clutch ball holes 52 against polygonal surfaces of drive shank 60 as shown in FIG. 7 to prevent rotation of driving portion 14 relative to the rotating portion 12.

The axial distance between release ball hole 50 and clutch ball holes 52 is such that when clutch balls 48 are released, lock ball 16 is still locked in position. Only further movement of release cylinder 26 toward chuck shank 20 will permit the release of the lock ball.

The rotating portion 12 of the clutch driver will rotate whenever chuck shank 20 is locked into the power drill and the power drill is turned on. Release cylinder 26 is free to rotate around drive shaft 18 if manually held.

Driving portion 14 includes spindle 58 which at one end has a drive shank 60 of polygonal cross-section as shown in FIG. 7. In a preferred embodiment the polygons are hexagons at both ends although other polygonal shapes could be used equally as well. Drive shank 60 has a groove 64 that extends around the shank and its centerline as best seen in FIGS. 5 and 6. Whenever drive shank 60 is placed within cylindrical opening 22 of drive shank 18 with lock ball 16 locked within groove 64, driving portion 14 can not move axially relative to rotating portion 12. It should be appreciated however that shank 60 is still free to rotate within drive shank 18 with lock ball 16 in place because the indentation 64 extends around shank 60.

Figure 9:
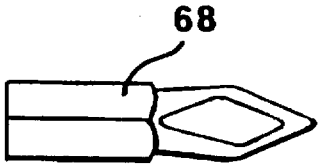
FIG. 9 is an elevational view of a screwdriver as used in the present invention.
Figure 10:
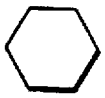
FIG. 10 is an end view of the screwdriver shown in FIG. 9.

At an end of spindle 58 opposite drive shank 60, a polygonal opening 62 is provided for accepting a polygonal shaped driving portion of a screwdriver bit 68 as shown in FIGS. 9 and 10. A magnet 66 is located within spindle 58 adjacent polygonal opening 62 to magnetically hold screwdriver bit 68, inserted into polygonal opening 62. Bit 68 is prevented from rotating within the opening by the polygonal shape of the mated screwdriver bit and polygonal opening.

A cylindrical sleeve 70 surrounds spindle 58 adjacent polygonal opening 62. Sleeve 70 has an inwardly extending flange 71 provided at the end opposite the screwdriver bit 68 end of sleeve 70. Sleeve 70 is held on the spindle by spring clip 72 as shown in FIG. 5 which coacts with flange 71 to prevent removal of sleeve 70 from spindle 58. Sleeve 70 is free to move axially along spindle 58. When sleeve 70 is extended, the sleeve assists in holding a screw in position as the screwdriver bit engages a screw at the start of the driving operation. Sleeve 70, when it is extended, can rest on the workpiece and be pushed back toward chuck shank 20 as the screw is driven. As the screw is driven into the workpiece, sleeve 70 is pushed by the workpiece toward chuck shank 20. The sleeve finally comes to abut a depth-adjusting collar 54 located on the exterior surface of release cylinder 26 as shown in FIGS. 2 and 5. Depth-adjusting collar 54 is threaded on exterior threads 30 of release cylinder 26 to select the depth of screw penetration into a workpiece. Collar 54 can then be locked into position by threadably tightening a lock ring 56, also threadably mounted on the exterior surface of release cylinder 26, against the depth-adjusting collar.

When sleeve 70 is pushed by the workpiece against depth-adjusting collar 54, further movement of the screw into the workpiece moves sleeve 70 to push depth-adjusting collar 54 toward chuck shank 20. Since depth-adjusting collar 54 is threaded to release cylinder 26, release cylinder 26 also moves toward chuck shank 20 against the bias of spring 36.

Depending on the depth of penetration of the screw in the workpiece, there will be a depth at which the release cylinder positions clutch ball release groove 46 over clutch balls 48. This releases the clutch balls 48 from their position of pressing against drive shank 60 so that driving portion 14 is no longer rotated by rotating portion 12. Polygonal shaped drive shank 60 is thus free to rotate within cylindrical opening 22 so that the screw is not driven further into the workpiece. Depth-adjusting collar 54 may be threadably adjusted to determine the depth screws are driven before clutch balls 48 disengage from drive shank 60.

In operation chuck shank 20 is placed in the chuck of a power drill. Sleeve 70 is extended away from chuck shank 20 to hold a screw in position in front of screwdriver bit 68. As the screw is driven into the workpiece, sleeve 70 presses against the workpiece.

Within rotating portion 12, lock ball 16 is positioned in indentation 64 to lock rotating portion 12 and driving portion 14 together axially. The rotating portion 12 and driving portion 14 may freely rotate relative to one another. To prevent relative rotation, the release cylinder 26 presses the clutch balls 48 against the polygonal faces of drive shank 60. The power drill drive force is then transmitted with this structure from rotating portion 12 to driving portion 14 and thence to the screw. Spring 36 biases release cylinder 26 so that lock ball 16 and clutch balls 48 are locked into place and a screw can be driven into the workpiece.

Eventually, as the screw is driven to the predetermined depth, sleeve 70 presses against depth-adjusting collar 54 which moves the release cylinder 26 to a position where clutch ball release groove 46 is directly located over clutch balls 48 whereby clutch balls 48 are disengaged from driving relation with the polygonal faces of drive shank 60. Driving portion 14 then stops rotating while rotating portion 12 continues to rotate as long as the power drill is switched on. By threadably adjusting depth-adjusting collar 54 on release cylinder 26 and using lock ring 56 to hold the setting, additional screws can be driven all to the same predetermined depth.

Figure 11:
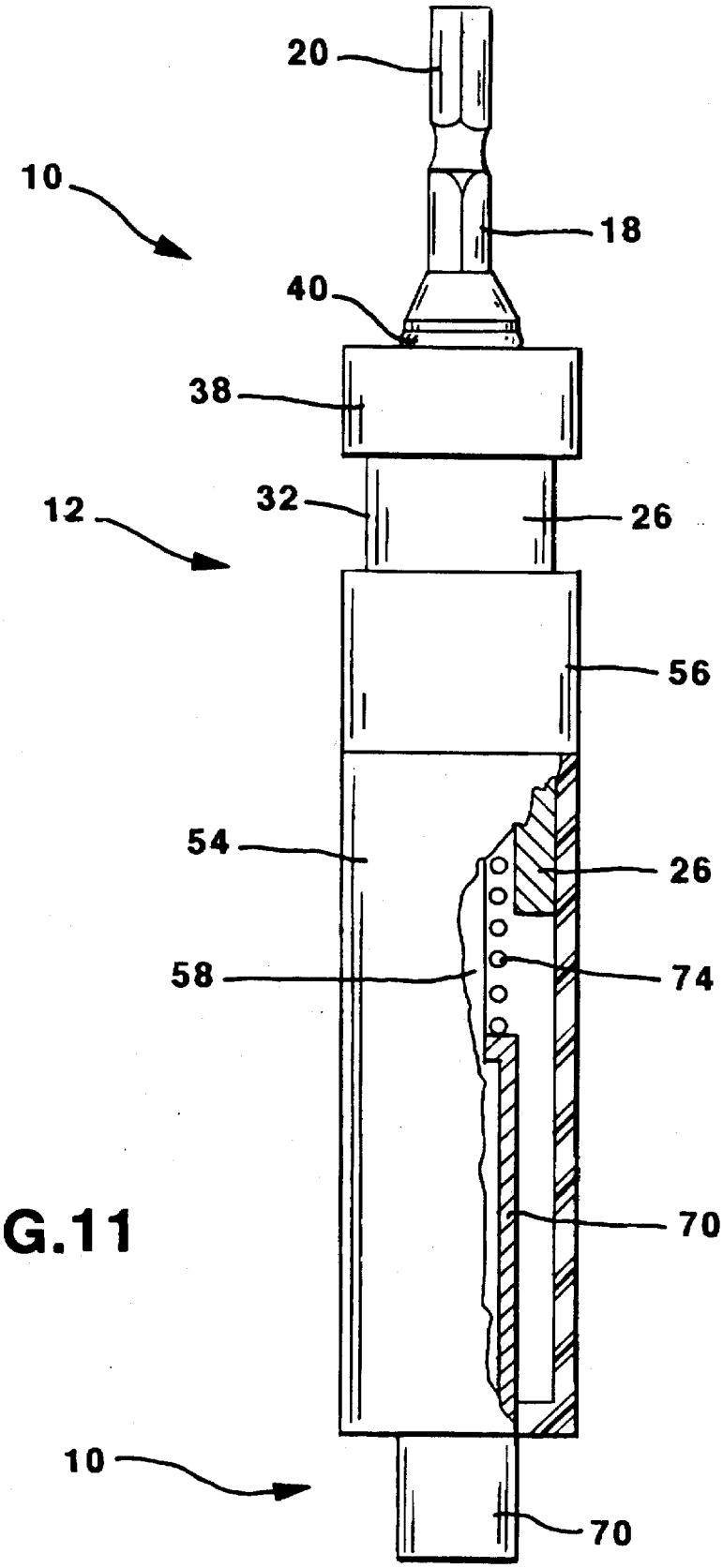
FIG. 11 is an elevational view of a second embodiment of the present invention with parts broken away.

A second embodiment of clutch driver 10 is shown in FIG. 11. The second embodiment is structurally similar to the first embodiment. However, in this embodiment sleeve 70 is not used to push the release cylinder 26. Sleeve 70 is only used to hold screws in place before driving the screw into the workpiece. A coil spring 74 is provided in coaxial relation with spindle 58 and is compressed between the end of drive shaft 18 and an end of sleeve 70. Spring 74 is used to bias sleeve 70 outwardly to cover the screw.

The depth-adjusting collar 54 in this embodiment is made longer than in the first embodiment. The depth-adjusting collar 54 is still threadably connected to release cylinder 26. In this embodiment depth-adjusting collar 54 is used to move the release cylinder when depth-adjusting collar 54 pushes against the workpiece. At the preset depth set by the collar 54 the clutch balls 48 are disengaged from drive shank 60 in a manner similar to the first embodiment.

In this second embodiment, the operational sequence is essentially the same as the first embodiment. The major difference occurs because sleeve 70 is no longer used to disengage the driving portion from the rotating portion. Sleeve 70 slides along spindle 58 as the screw is driven and is used only to hold a screw during the screw driving operation. The much longer depth-adjusting collar 54 eventually presses against the workpiece and release cylinder 26 simultaneously, just before the screw reaches its predetermined depth. Depth-adjusting collar 54 in the second embodiment then moves release cylinder 26 directly toward chuck shank 20 as the screw is driven further into the workpiece. This results in a similar action as the first embodiment in that the driving portion 14 is rotatably disengaged from the rotating portion 12.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. A clutch drive for driving a screw to a predetermined depth into a workpiece with the clutch drive being held by the chuck of a power drill, the clutch drive comprising:

an elongate drive shaft having a chuck shank at one end and a cylindrical opening at the other end, the chuck shank shaped to be accepted by the chuck of the power drill whereby the drive shaft rotates about a longitudinal axis of the drive shaft with rotation of the power drill;

a spindle having a drive shank at one end and a polygonal opening at the other end to accept a screw driver bit, the drive shank having an end positioned within the cylindrical opening of the drive shaft;

the spindle further including a magnet adjacent the polygonal opening for attracting the screw driver bit;

an actuatable clutch means connected to the drive shaft for normally rotationally coupling the spindle to the drive shaft;

a locking means connected to the drive shaft for axially locking the spindle to the drive shaft while allowing rotational motion between the spindle and the drive shaft;

a hollow release cylinder slideably positioned around the drive shaft, the release cylinder being moveable from a first position where the clutch means rotationally couples the spindle to the drive shaft to a second position where the spindle is rotationally de-coupled from the drive shaft;

the drive shank formed to have a polygonal cross-section;

the clutch means comprising a ball, held within a clutch hole in the drive shaft and locked against an exterior face of the drive shank by the release cylinder when the release cylinder is in the first position and released from the drive shank when the release cylinder is in the second position;

a resilient means for normally biasing the release cylinder to the first position;

an actuator sleeve slideably extending along the spindle between an end of the release cylinder distal from the chuck shank and the workpiece, the length of the actuator sleeve being selected to push the release cylinder toward the chuck shank when the predetermined depth is reached whereby the release cylinder is moved to the second position to de-couple the spindle from the drive shaft;

stop means located on the spindle for coacting with the actuator sleeve to prevent the actuator sleeve from sliding off the spindle; and a depth-adjustment sleeve threadably secured to the release cylinder to adjust the length of the release cylinder by rotating the depth-adjustment means with respect to the release cylinder whereby the predetermined depth may be adjusted.

* * * * *